US007046380B2

(12) United States Patent
Nishiberi et al.

(10) Patent No.: US 7,046,380 B2
(45) Date of Patent: May 16, 2006

(54) RECORDING APPARATUS WITH FEED CONTROL BASED ON LEADING END MARGIN AMOUNT

(75) Inventors: Nozomu Nishiberi, Yokohama (JP); Masaya Shinmachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 864 days.

(21) Appl. No.: 09/788,464

(22) Filed: Feb. 21, 2001

(65) Prior Publication Data

US 2001/0030763 A1 Oct. 18, 2001

(30) Foreign Application Priority Data

Feb. 22, 2000 (JP) ..... 2000-043967

(51) Int. Cl.
*G06F 3/12* (2006.01)
*G06F 13/00* (2006.01)

(52) U.S. Cl. ..... 358/1.12; 358/1.14

(58) Field of Classification Search ..... 358/1.12, 358/1.13, 1.14, 1.15, 1.01–1.1, 1.16–1.18; 271/110, 111, 270, 3.06, 3.09, 4.12; 399/391, 399/370

See application file for complete search history.

(56) References Cited

U.S. PATENT DOCUMENTS

| | | | | |
|---|---|---|---|---|
| 5,223,858 | A * | 6/1993 | Yokoi et al. | 346/134 |
| 5,725,319 | A | 3/1998 | Saito et al. | 400/629 |
| 5,738,453 | A | 4/1998 | Tsuburaya et al. | 400/624 |
| 5,899,613 | A | 5/1999 | Koike et al. | 399/384 |
| 5,902,058 | A | 5/1999 | Koike et al. | 400/578 |
| 5,921,690 | A | 7/1999 | Shinmachi et al. | 400/625 |
| 5,984,300 | A | 11/1999 | Nishiberi | 271/171 |
| 6,089,564 | A * | 7/2000 | Matsumoto et al. | 271/161 |

* cited by examiner

*Primary Examiner*—Douglas Q. Tran
(74) *Attorney, Agent, or Firm*—Fitzpatrick, Cella, Harper & Scinto

(57) ABSTRACT

A recording apparatus in which a total recording time can be shortened by decreasing a feed time efficiently, in a case where continuous recording is performed on a plurality of recording media. This recording apparatus includes a feed roller for feeding a plurality of recording media one by one, a conveying roller for conveying the recording medium fed by the feed roller to a recording device, and the recording device for performing a record on the recording medium conveyed by the conveying roller. In this apparatus, when a succeeding recording medium is fed during discharge of the recording medium on which the record has been completed, a feed start timing by the feed roller is determined in accordance with a leading end margin amount for the succeeding recording medium.

9 Claims, 4 Drawing Sheets

RECORDING APPARATUS WITH FEED CONTROL BASED ON LEADING END MARGIN AMOUNT

BACKGROUND OF THE INVENTION

1. Field of the Invention

The present invention relates to a recording apparatus used as an output apparatus of a host computer such as a personal computer or a work station, or as a recording portion in a facsimile or a copying machine.

2. Related Background Art

Conventionally, a recording apparatus is composed of, an auto-sheet feeder in which a plurality of recording media are stored, a feed roller having a friction member for feeding the recording media from the auto-sheet feeder into a main body of the recording apparatus, a conveying roller for sub-scanning the recording media in the main body of the recording apparatus, a conveying pass portion provided between the feed roller and the conveying roller, and a recording medium detecting portion (hereinafter referred to as a "detecting portion") provided at a predetermined position in the conveying pass portion.

In the above structure, after a recording medium fed by the feed roller that feeds the recording media one by one is passed through the detecting portion, the recording medium is fed to a nip position where the conveying roller is in pressure-contact with a pinch roller that is rotated by the rotation of the conveying roller, and then conveyed by the conveying roller to a recording portion for main-scanning a recording head. When registration for the recording medium fed by the feeding roller is performed in the nip position, the conveying roller is stopped or reversed to be struck by the fed recording medium in a nip position, and then the recording medium is conveyed by the conveying roller. On the other hand, when the registration is not performed, the recording medium is fed to the nip position in a state that the conveying roller is rotated forward in advance. Whether the registration is performed or not is selected in accordance with a thickness of the recording medium and rigidity thereof.

There are the case where the feeding roller and the conveying roller are driven by one motor as a driving source and the case where these rollers are driven by different driving sources, respectively. However, when one motor is used, a structure for switching the feeding roller and the conveying roller is complicated and reliability is degraded. Also, when recording for a plurality of recording media is performed, a switching time becomes long. Therefore, the structure in which the feeding roller and the conveying roller are driven by different driving sources has an advantage with respect to a total recording time in recording for the plurality of recording media. Also, by using different driving sources, during discharge of a first recording medium, feeding of a second recording medium can be performed easily, whereby a recording time can be shortened further.

However, in the above structure, during discharge operation of the first recording medium (hereinafter referred to as a "preceding recording medium") in which recording has completed, in a case where feeding of the second recording medium (hereinafter referred to as a "succeeding recording medium") to be fed next is performed at a time when the trailing end of the preceding recording medium is detected by a detecting sensor by passing through the detecting portion, the trailing end of the preceding recording medium may be on the discharge roller at the start of recording to the succeeding recording medium depending on the size of the apparatus. If so, the trailing end of the preceding recording medium is caught on the recording head, whereby a jam or the like may occur.

To prevent this, it is necessary to take some time between a time when feeding the succeeding recording medium and a time when the recording medium detecting sensor detects the trailing end of the preceding recording medium, whereby a feed time period is increased slightly that much. Thus, when recording for several tens of recording media is performed, since an idle time is accumulated to be unnegligible in total.

SUMMARY OF THE INVENTION

To solve the above problems, it is an object of the present invention to provide a recording apparatus capable of shortening a total recording time by decreasing a feed time efficiently, in the case where recording for a plurality of recording media is performed continuously.

To achieve the above object, according to the typical structure of the present invention, there is provided a recording apparatus including: feeding means for feeding recording media one by one; conveying means for conveying the recording medium fed by the feeding means to a recording area; and recording means for performing recording on the recording medium conveyed by the conveying means, characterized in that when a succeeding recording medium is fed during discharge of a recording medium in which recording has completed, a feed start timing by the feeding means is determined in accordance with a leading end margin amount for the succeeding recording medium.

In the above structure, a feed timing to start recording for the succeeding recording medium simultaneously with discharge of the preceding recording medium can be obtained in accordance with the leading end margin amount obtained in advance, and a feed time period and a recording time period can be shortened in a case where recording for a plurality of recording media is performed continuously.

These and other advantages of the present invention will become apparent to those skilled in the art upon reading and understanding the following detailed description with reference to the accompanying drawings.

DESCRIPTION OF THE PREFERRED EMBODIMENTS

Figure 1:
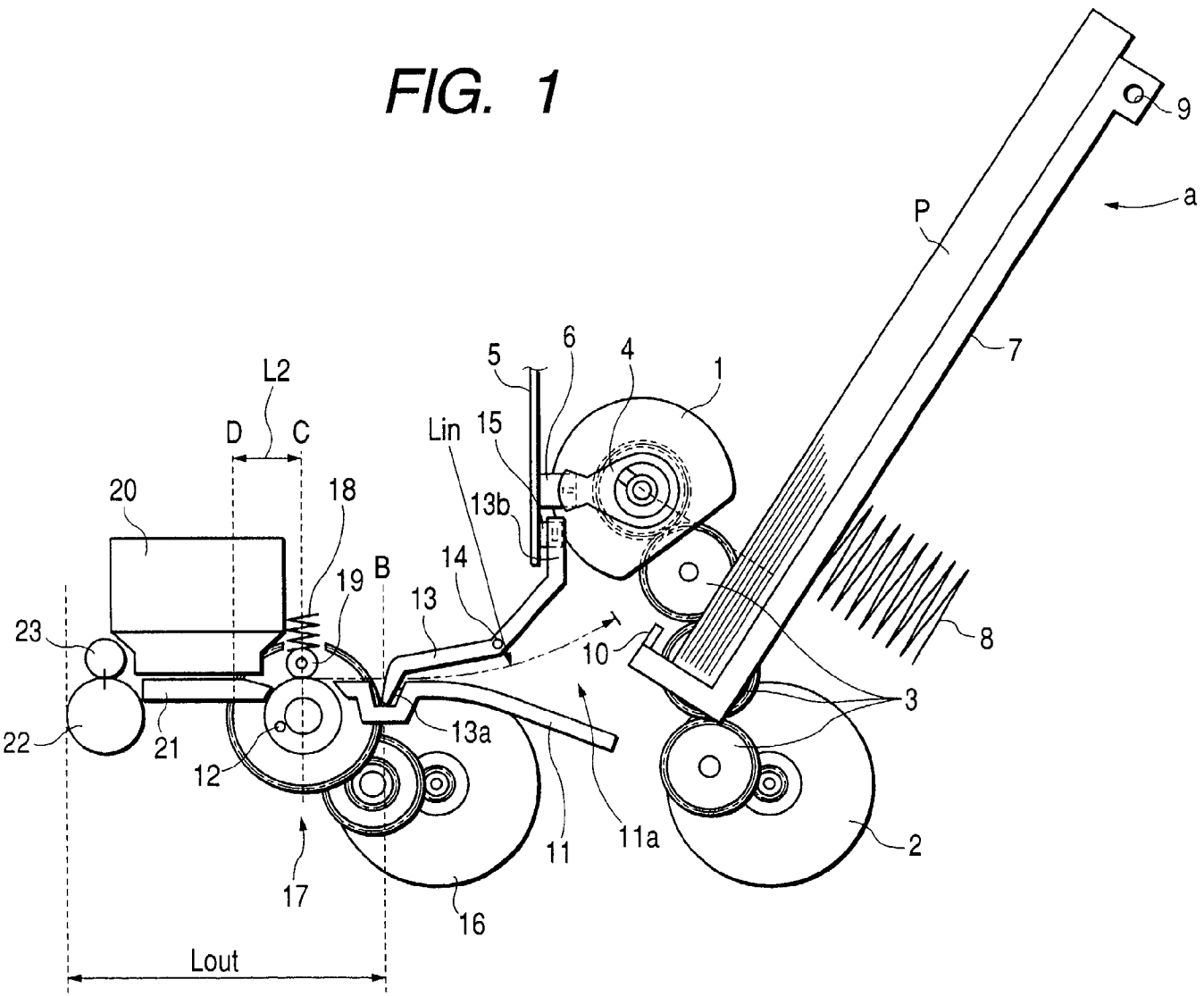
FIG. 1 is a schematic explanatory view of a recording apparatus according to the present invention.
Figure 2:
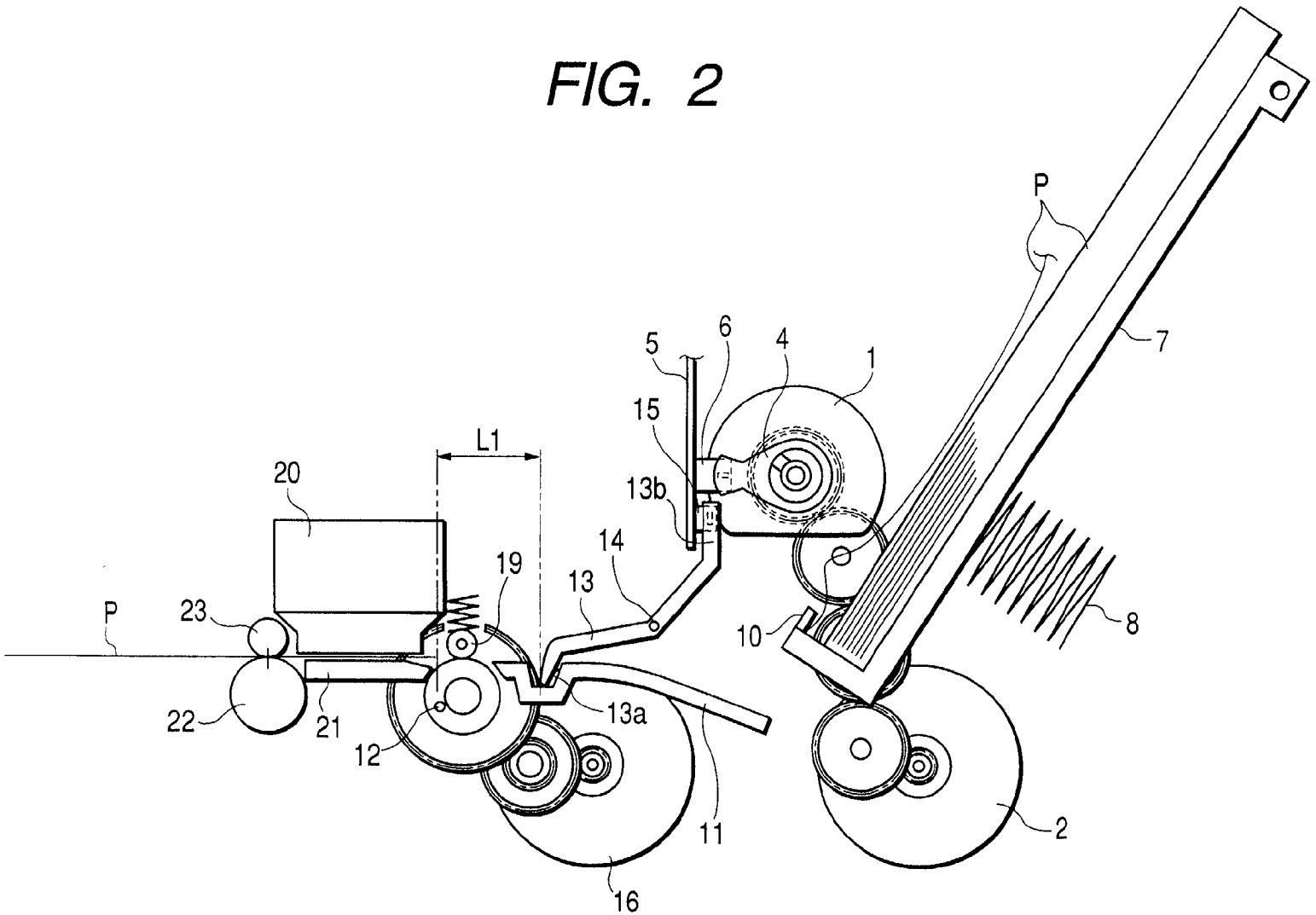
FIG. 2 is a view representing a state where a preceding recording medium has been conveyed and the trailing end thereof has shifted by a distance L1 from a detecting position.
Figure 3A:
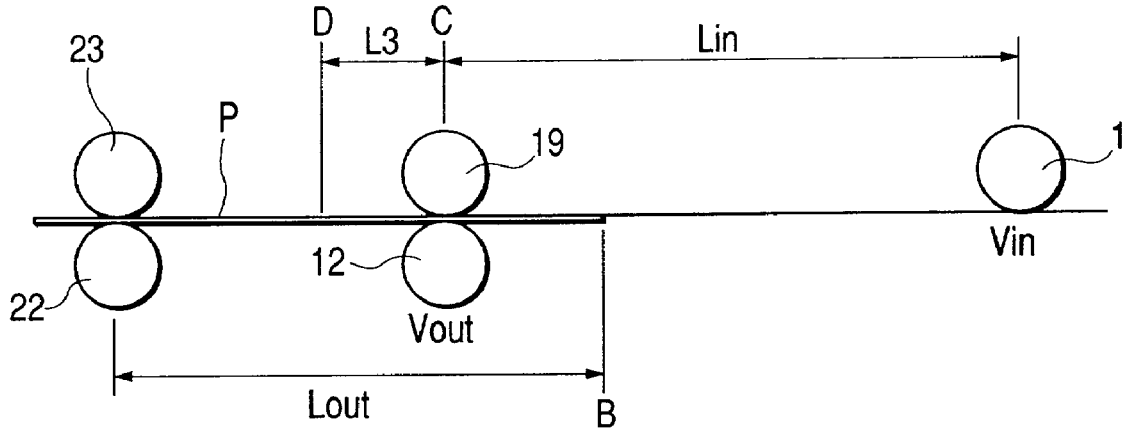
FIGS. 3A and 3B are explanatory views representing the states where the trailing end of the preceding recording medium has passed through the detecting position.
Figure 3B:
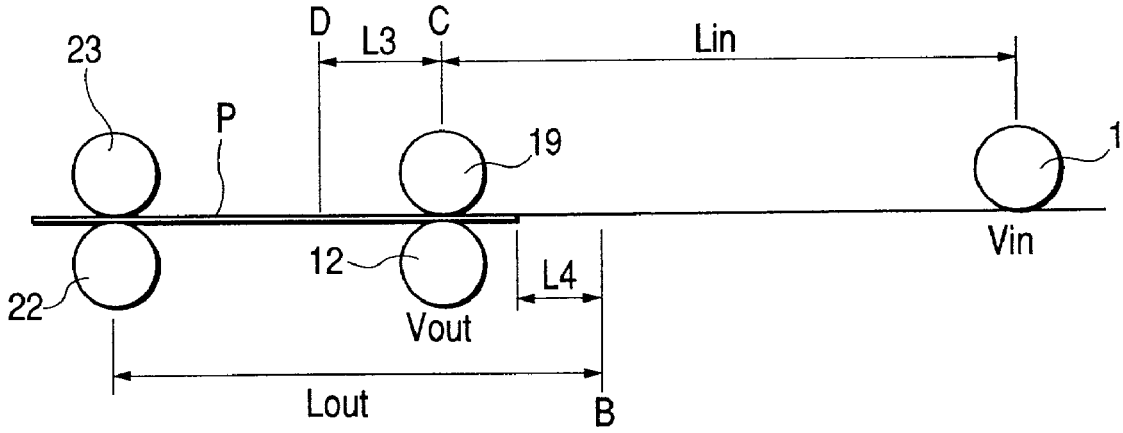

Hereinafter, a recording apparatus according to an embodiment of the present invention will be described by way of illustrative examples with reference to FIGS. 1, 2, 3A and 3B. FIG. 1 is a schematic explanatory view of a recording apparatus according to the present invention. FIG. 2 is a view representing a state where a preceding recording medium has been conveyed and the trailing end thereof has shifted by a distance L1 from a detecting position. FIGS. 3A and 3B are explanatory views representing the states where the trailing end of the preceding recording medium has passed through the detecting position.

(The Entire Structure of the Recording Apparatus)

Firstly, the entire structure of the recording apparatus will be described simply. As shown in FIG. 1, in the recording apparatus according to this embodiment, a feed roller 1 as a feeding means is rotated by a driving force of a feed motor 2 transmitted through a feed roller gear train 3. The feed roller 1 is a semicircular roller having a cut portion in a circle. An initial position of the feed roller 1 is detected by a lever portion 4 having the same rotary shaft as the feed roller 1 and a feed roller sensor 6 attached to a base plate 5 provided in the apparatus main body.

A plurality of recording media P to be stacked are set on a pressure plate 7. The pressure plate 7 is interlocking with the rotation of the feed roller 1 through a cam (not shown). When the feed roller 1 is started to rotate, the pressure plate 7 is moved about a rotary shaft 9 as a center in a direction indicated by the arrow "a" shown in FIG. 1 by a pressure plate spring 8 which is released from the restriction, so that the recording media P set on the pressure plate 7 are pressure-contacted with the feed roller 1. A separation claw 10 for separating the stacked recording media P one by one is provided at the distal end of the pressure plate 7. Only the uppermost one of the stacked recording media P is separated and fed by the rotated feed roller 1.

The fed recording medium is guided with a paper pan 11 forming a conveying pass, and fed to a conveying roller 12 constituting conveying means. A space 11*a* for forming a loop in registering at a feed roller position is defined by the paper pan 11.

A sensor lever 13 as detecting means for detecting the recording media P fed from the feed roller 1 to the conveying roller 12 is provided between the feed roller 1 and the conveying roller 12. The sensor lever 13 can be rotated about a shaft 14, one end 13*a* is protruded to the conveying pass of the recording medium, and the other end 13*b* is positioned in a detecting sensor 15 constituted by a photosensor. When the leading end of the recording medium to be fed is passed through the position of the one end 13*a*, the sensor lever 13 is pushed up to rotate. When the trailing end of the recording medium is passed, the sensor lever 13 is rotated and returned to an original position. By this rotation, since the other end 13*b* is moved in an optical pass of the detecting sensor 15, it can be detected that the leading end and the trailing end of the recording medium have passed through the one end position (detecting position B) of the sensor lever 13.

The conveying roller 12 is provided downstream of the detecting position B in a recording medium conveyance direction. The conveying roller 12 is rotated by a driving force of another step motor 16, that is separate from the feed motor 2, transmitted through a gear train 17. A pinch roller 19 biased by a spring 18 is pressure-contacted with the conveying roller 12 such that the pinch roller 19 is rotated by the rotation of the conveying roller 12. The fed recording medium is nipped by the rollers 12 and 19 at a nip position "C" and conveyed to a recording position, so that a predetermined image is recorded.

In this embodiment, a serial type ink-jet recording system is applied to recording means for recording an image onto the recording medium. A recording head 20 of this embodiment includes liquid discharge fine openings (orifices), a liquid passage, an energy applying portion provided in a portion of this liquid passage, and energy generating means for generating liquid drop forming energy to be applied to a liquid in the energy applying portion. The recording head 20 is mounted on a carriage (not shown). The recording for the recording medium held by a platen 21 is performed by jetting out ink in response to an image signal while the carriage reciprocates in a direction orthogonal to the recording medium conveyance direction.

Figure 4:
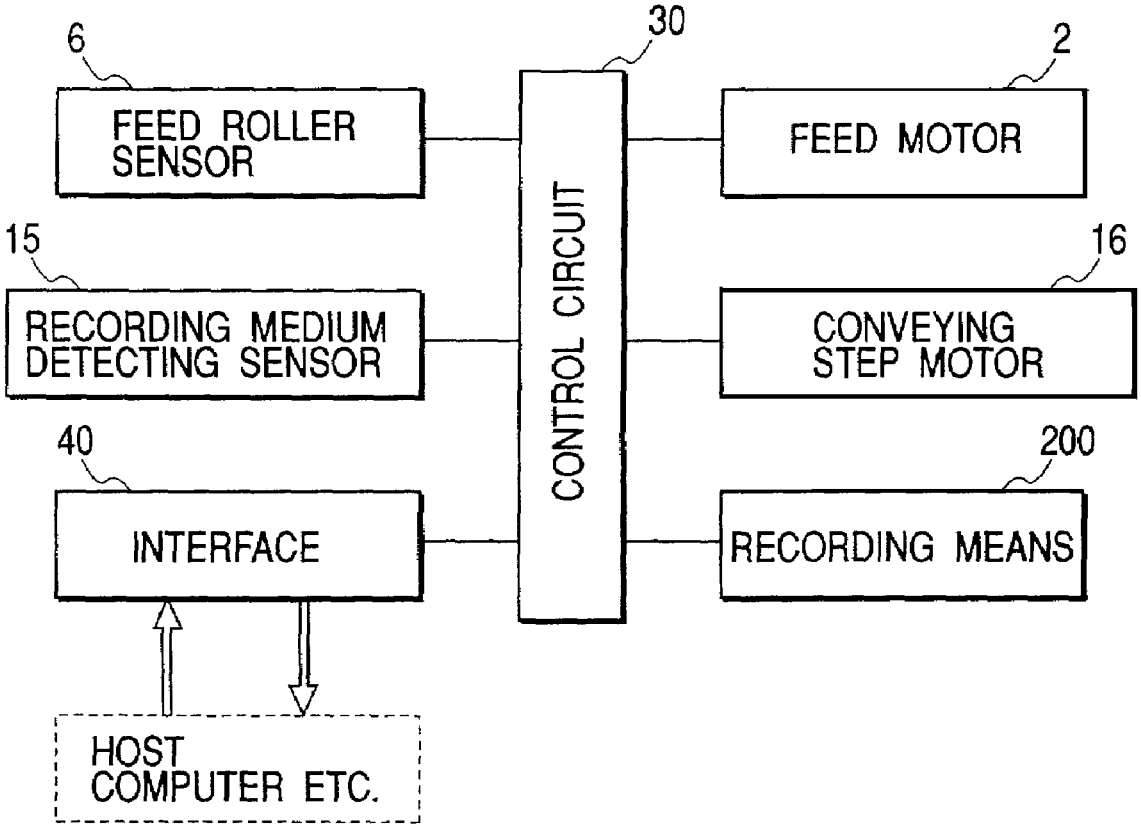
FIG. 4 is a control block diagram of the recording apparatus.

FIG. 4 is a control block diagram of the recording apparatus of this embodiment.

Reference numeral 30 is a control circuit as control means having a CPU, a memory and the like. Reference numeral 40 is an interface for receiving leading end margin information, image information and a recording command from an external host computer etc., and transmitting these information to the control circuit. Numeral 200 is a recording means having a recording head 20, a carriage driving motor (not shown), and the like.

The control circuit 30 drive-controls the feed motor 2 and the conveying step motor 16, in accordance with a recording command received through the interface 40, to feed the leading end of the recording medium to an initial position to feed the recording medium to a recording start position. Next, the control circuit 30 drives the recording means 200 to perform one line recording having a predetermined width for the recording medium. Then, the control circuit 30 drives the conveying step motor 16, to convey the recording medium by a distance corresponding to one line and stop it, and controls the recording means 200 to perform next line recording. When the recording is completed, the control circuit 30 drives the conveying step motor 16 to discharge the recording medium. If next recording is to be performed, the control circuit 30 drives the feed motor 2 at a timing mentioned below to feed a leading end of a succeeding recording medium to the initial position.

In the energy generating means for ink discharge in the recording head 20, a recording method using an electromechanical transducer such as a piezo element, a recording method using energy generating means for discharging a liquid drop by heat generated by irradiating an electromagnetic wave such as a laser, a recording method using energy generating means for discharging a liquid after it is heated by the electro-thermal transducer such as a heating element having a heating resister, or the like is used.

Of the above mentioned methods, a recording head used in the ink-jet recording method for discharging a liquid by the heat energy is capable of recording of high resolution since liquid discharge openings (orifices) to form a discharge liquid drop by discharging a liquid drop for recording can be arranged at a high density. Of this type of recording heads, one that uses an electro-thermal transducer as energy generating means is advantageous because it is easy to reduce its size, is suitable for high density mounting, and is manufacturable with low cost.

In this embodiment, an ink discharge structure is as follows. An electro-thermal transducer is energized in response to an recording signal, and by utilizing film boiling produced in ink by thermal energy, the ink is discharged from discharge openings by growth and contraction of bubble produced in ink, so that the recording is performed.

The recording medium in which an ink image is recorded is discharged to the outside of the apparatus by a discharge roller 22 to be drive-rotated and a follower spur 23 to be rotated by pressing the recording medium to the discharge roller 22. The spur represents a rotor that comes into contact with the recording medium in a small contact area, and that does not disturb an ink image if it brought into contact with the surface of the recording medium in which the ink image is recorded by ink discharge.

(Feed Timing of Recording Medium)

In the above recording apparatus, a recording medium feed timing in the case where a plurality of recording media are fed continuously and images are recorded, will be described below.

When a driving command is supplied from the control circuit 30 to the feed motor 2, the feed roller 1 is rotated by the feed roller gear train 3, and then one recording medium of the stacked recording media P is separated and fed. When the leading end of the fed recording medium is passed through the detecting position "B", the sensor lever 13 is rotated and detected by the detecting sensor 15. Further, the leading end of the recording medium is conveyed to the nip position "C". In the case where the registration is performed, the conveying roller 12 is stopped. In the case where the registration is not performed, the conveying roller 12 is rotated forward. The apparatus of this embodiment can be applied to both cases where the registration is performed and the registration is not performed.

The recording medium conveyed to the nip position "C" is conveyed to a recording position by the conveying roller 12 to perform the predetermined recording. Operation so far is the same as a conventional apparatus.

A point of the present invention is in a feed timing of the second recording medium (succeeding recording medium) after recording of the first recording medium (preceding recording medium) has completed. In order to make this point understood easily, a conventional example will be first described. In FIG. 1, a distance between the detecting position "B" of the recording medium by the detecting sensor 15 and a position that discharge of the recording medium has completed is given as Lout, and a distance between the leading end of the recording medium to be fed and the nip position "C" is given as Lin.

When recording of the preceding recording medium has completed and when a discharge command is supplied, discharge operation is performed. Here, in order to perform recording of the succeeding recording medium quickly, it is ideal that the succeeding recording medium is fed as soon as possible.

However, if the succeeding recording medium is fed too early, recording of the succeeding recording medium is performed in a state that the preceding recording medium is not discharged from the discharge roller 22, whereby a fault that the trailing end of the preceding recording medium is caught by the recording head 20 occurs. Therefore, a conventional timing for feeding the succeeding recording medium is as follows.

When a conveying speed by the conveying roller 12 is given as Vout and a conveying speed by the feed roller 1 is given as Vin, a period of time tout between a discharge completion and a time immediately after the trailing end of the preceding recording medium is passed through the detecting position "B" is represented by the following equation, $$t\mathrm{out}=L\mathrm{out}/V\mathrm{out}.$$

Also, when a distance between the nip position "C" and the recording position "D" including a minimum leading end margin of the recording medium is given as L2, and a period of time between a time when the succeeding recording medium reaches to the recording position "D" and a time when its feed is started is given as tin, since the succeeding recording medium from the nip position "C" is fed at Vout, the period of time tin is represented by the following equation, $$t\mathrm{in}=L\mathrm{in}/V\mathrm{in}+L2/V\mathrm{out}.$$

Here, the leading end margin amount of the recording medium varies depending on the recording data. Conventionally, after the recording medium is conveyed to a minimum margin position once, a regular margin information is recognized and the recording medium is conveyed to a regular margin position again. Thus, at feeding of the succeeding recording medium, the margin information thereof is not recognized yet, whereby the feed period of time tin is kept constant. As a result, from the above equations, a condition for completely discharging the preceding recording medium at the start of recording of the succeeding recording medium is $$\mathrm{tin}>\mathrm{tout}.$$

Conventionally, this relationship is not obtained from the structure of a mechanism. Therefore, after the trailing end of the preceding recording medium is passed through the detecting position "B", as shown in FIG. 2, the preceding recording medium is conveyed by the distance L1, and then feeding of the succeeding recording medium is started. The distance L1 is obtained as follows.

When tout=tin, $$(L\mathrm{out}-L1)/V\mathrm{out}=L\mathrm{in}/V\mathrm{in}+L2/V\mathrm{out},$$

whereby, $$L1=Lout-L2-Lin\times Vout/Vin.$$

In contrast to this, in the recording apparatus of this embodiment, a regular initial feeding amount L3 (a distance between the nip position "C" and the leading end of the recording medium at start of recording) is recognized in advance by the recording apparatus when feeding the succeeding recording medium, a feed timing of the succeeding recording medium is determined in accordance with the initial feeding amount L3. The description will hereinafter be made by divided into two-ways in which the trailing end of the recording medium has not passed through the detecting position "B" at the time of recording completion and the trailing end has already passed through the detecting position "B".

When the trailing end of the recording medium has not been passed through the detecting position "B" upon recording completion, as shown in FIG. 3A, before discharge operation of the preceding recording medium is performed, both of (1) a recording command of the succeeding recording medium and (2) the information L3 of the leading end margin amount of the succeeding recording medium are received in advance from a host system. During the discharge operation of the preceding recording medium, a period of time from detection of the trailing end of the preceding recording medium by the detecting sensor 15 to start of feeding of the succeeding recording medium is given as T3. By setting the period of time T3 so as to obtain the following relationship, $$Tout=tin+T3,$$

discharge of the preceding recording medium is completed at the start of recording of the succeeding recording medium. That is, by determining T3 so as to obtain the following relationship, $$T3=tout-tin=Lout/Vout-(Lin/Vin+L3/Vout)=(Lout-L3)/Vout-Lin/Vin,$$

feeding is started at a minimum period of time.

That is, when the period of time T3 is elapsed after the trailing end of the preceding recording medium is passed through the detecting sensor 15, feeding of the succeeding recording medium is started.

If the following relationship, $$Lout/Vout<L3/Vout-Lin/Vin,$$

is obtained, feeding of the succeeding recording medium is started immediately after the trailing end of the preceding recording medium is detected by the detecting sensor 15.

From the above relationships, when the preceding recording medium is discharged, the period of time T3 from a time when the trailing end of the preceding recording medium is passed through the detecting sensor 15 to the start of the feeding of the succeeding recording medium is shortened as setting of a leading end margin of recording for the succeeding recording medium becomes large.

Namely, when the preceding recording medium is discharged, the period of time from the trailing end of the preceding recording medium being passed through a predetermined position to the start of feeding of the succeeding recording medium is shortened as setting of a leading end margin of recording for the succeeding recording medium becomes large.

The case in which the trailing end of the preceding recording medium has passed through the detecting position "B" before the discharge operation on the recording completion of the preceding recording medium will be described below. As shown in the schematic view of FIG. 3B, a distance from the detecting position "B" to the trailing end of the preceding recording medium on the start of discharge is given as L4. The distance L4 is obtained by counting the number of drive steps of the conveying step motor 16 by a counter of the control circuit 30 after the trailing end of the recording medium is detected by the detecting sensor 15.

Timing T4 where the succeeding recording medium is fed, is determined with reference to its passing movement amount L4, as mentioned below.

$$tout-T4=tin$$

$$T4=tout-tin=(Lout-L4-L3)/Vout-Lin/Vin.$$

That is, by feeding the succeeding recording medium after the period of time T4 is elapsed from when a discharge command of the preceding recording medium is received, a period of time required to start feeding of the succeeding recording medium can be minimized.

From the above equation, as the distance between the detection sensor and its downstream position of the trailing end at the start of discharge is large when the preceding recording medium is discharged, the period of time T4 from the start of discharge to the start of feeding of the succeeding recording medium is shortened. Simultaneously, as setting of a leading end margin of recording for the succeeding recording medium becomes large, the period of time T4 is shortened.

Namely, as the distance between a predetermined position and the trailing end downstream of the predetermined position at the start of discharge is large when the preceding recording medium is discharged, the period of time T4 from the start of discharge to the start of feeding of the succeeding recording medium is shortened. Simultaneously, as setting of a leading end margin of recording for the succeeding recording medium becomes large, the period of time T4 is shortened.

As described above, when the succeeding recording medium is fed during discharge of the recording medium in which the recording has completed, by determining a feed start timing in accordance with the leading end margin amount of the succeeding recording medium, the recording media can be fed continuously at a minimum period of time.

In the above embodiment, an ink-jet recording system is exemplified as the recording means. However, a recording system is not limited to this ink-jet recording system. For example, an electrophotographic recording system, a thermal transfer recording system or the like may be used.

Also, the feeding means and the conveying means are not limited to a roller shaped member, but may be a member constituted of, for example, a rotation belt.

Further, the detecting means for the recording medium is not limited to a constitution of detecting rotation of the above sensor lever by a sensor, but may be a constitution to detect the recording medium itself by a photosensor.

According to the present invention, because of the above constitution, a feed timing to start recording of the succeeding recording medium can be obtained simultaneously with discharge of the preceding recording medium, in accordance with the leading end margin amount to be obtained in advance, whereby a feed time and a recording time can be shortened in the case wherein continuous recording is performed for a plurality of recording media.

What is claimed is:

1. A recording apparatus for recording on a recording medium by a recording head comprising:

a feed roller for feeding recording medium one by one;

a conveying roller for conveying a recording medium fed by the feed roller to a recording area;

a discharge roller for discharging a recording medium from the recording area; and control means adapted to start the feeding of a succeeding recording medium by said feed roller before the discharge of a preceding recording medium by said discharge roller, wherein said control means changes a feed start timing from a time when a trailing end of the preceding recording medium is passed through a predetermined position to the start of the feeding of the succeeding recording medium by said feed roller in accordance with a leading end margin amount of the succeeding recording medium.

2. A recording apparatus according to claim 1, further comprising detecting means for detecting the recording medium conveyed between the feed roller and the conveying roller, wherein the feed start timing is determined based on a time when the recording medium in which the record has been completed is detected by the detecting means.

3. A recording apparatus according to claim 2, wherein when the recording medium in which the record has been completed is passing a detecting position of the detecting means on a start of a discharge operation of the recording medium, the feed start timing of the succeeding recording medium is determined by tempered with a passing movement amount of the recording medium.

4. A recording apparatus according to claim 1, wherein the feed roller and the conveying roller are driven by different driving means.

5. A recording apparatus according claim 1, wherein said control means performs a control operation so that a period of time when a trailing end of the preceding recording medium is passed through a predetermined position to a start of feeding of the succeeding recording medium by the feed roller is shorter, as a leading end margin amount of the succeeding recording medium is longer.

6. A recording apparatus according to claim 5, further comprising detecting means for detecting the recording medium conveyed between the feed roller and the conveying roller, wherein the predetermined position is a position where the trailing end of the preceding recording medium is passed through.

7. A recording apparatus according to claim 1, wherein when the discharge of the preceding recording medium by said discharge roller is started, said controlling means controls a control operation so that a period of time from a start of discharge of the preceding recording medium to a start of feeding of the succeeding recording medium is shorter, as a distance between a predetermined position and a trailing end of the preceding recording medium downstream of the predetermined position on the start of discharge is longer.

8. A recording apparatus according to claim 7, further comprising detecting means for detecting the recording medium conveyed between the feed roller and the conveying roller, wherein the predetermined position is a position where the trailing end of the preceding recording medium is passed through.

9. A recording apparatus according to claim 7, wherein said control means controls a control operation so that the period of time from the start of the discharge of the preceding recording medium by said discharge roller to the start of feeding of the succeeding recording medium by said feed roller is shorter, as a leading end margin amount of the succeeding recording medium is longer.

* * * * *

UNITED STATES PATENT AND TRADEMARK OFFICE

CERTIFICATE OF CORRECTION

PATENT NO. : 7,046,380 B2
APPLICATION NO. : 09/788464
DATED : May 16, 2006
INVENTOR(S) : Nozomu Nishiberi et al.

It is certified that error appears in the above-identified patent and that said Letters Patent is hereby corrected as shown below:

COLUMN 5:
Line 3, "above mentioned" should read --above-mentioned--.
Line 27, "it" should read --it is--.

COLUMN 9:
Line 41, "by" should read --by and--.

Signed and Sealed this

Sixth Day of March, 2007

JON W. DUDAS
*Director of the United States Patent and Trademark Office*